US008918926B1

(12) United States Patent
Herring

(10) Patent No.: US 8,918,926 B1
(45) Date of Patent: Dec. 30, 2014

(54) ONE PIECE SHOWER PAN AND METHOD OF MAKING SAME

(76) Inventor: Avery Scott Herring, Petal, MS (US)

( * ) Notice: Subject to any disclaimer, the term of this patent is extended or adjusted under 35 U.S.C. 154(b) by 0 days.

(21) Appl. No.: 13/178,180

(22) Filed: Jul. 7, 2011

Related U.S. Application Data

(63) Continuation-in-part of application No. 12/687,508, filed on Jan. 14, 2010.

(51) Int. Cl.
*A47K 3/00* (2006.01)
*A47K 3/40* (2006.01)

(52) U.S. Cl.
CPC ..... *A47K 3/40* (2013.01)
USPC ..... 4/613

(58) Field of Classification Search
CPC ..... A47K 3/40; A47K 3/283; E03F 5/0408
USPC ..... 4/612–614, 584, 595; 52/35, 302.1
See application file for complete search history.

(56) References Cited

U.S. PATENT DOCUMENTS

| | | | | |
|---|---|---|---|---|
| 3,987,714 | A * | 10/1976 | Campbell | 454/296 |
| 5,458,769 | A * | 10/1995 | Johannessen | 210/163 |
| 6,003,169 | A * | 12/1999 | Davis, Jr. | 4/613 |
| 7,739,757 | B2 * | 6/2010 | Witt | 4/613 |
| 2009/0307835 | A1 * | 12/2009 | Anastasi Vavvessi | 4/584 |
| 2012/0036629 | A1 * | 2/2012 | Cook | 4/613 |

* cited by examiner

*Primary Examiner* — Huyen Le
*Assistant Examiner* — Janie Christiansen
(74) *Attorney, Agent, or Firm* — Garvey, Smith, Nehrbass & North, L.L.C.; Gregory C. Smith; Julia M. FitzPatrick

(57) ABSTRACT

A one piece shower drain pan, encapsulated in a water proof membrane, wherein one embodiment provides a one piece shower pan which includes a recessed drain portion supporting a square insert made of pvc or poly vinyl material which includes a plurality of drain channels extending from the outer edge of each wall of the insert into the recessed drain portion. The insert would be covered by tile members similar to the tiles of the shower floor, so to provide the visual effect of no drainage opening in the floor of the shower. There would be provided a perimeter water flow space between the side edges of the tiles covering the insert and the edges of the surrounding tiles, so that water flowing onto the floor of the shower would flow through the perimeter water flow space, through the drain channels and into the main drain.

12 Claims, 5 Drawing Sheets

ONE PIECE SHOWER PAN AND METHOD OF MAKING SAME

CROSS-REFERENCE TO RELATED APPLICATIONS

This is a continuation-in-part of U.S. Non-Provisional patent application Ser. No. 12/687,508, filed Jan. 14, 2010, each of which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to shower pans. More particularly, the present invention relates to a shower pan and a method of fabricating same, wherein the shower pan when completed exists as a one piece unit ready for installation. In a second embodiment the main drainage opening is covered by the tile floor of the shower.

2. General Background of the Invention

In the general field of shower pans, it is a continuing problem that the shower pan which is easy to install and after installation is able to resist water and be leak proof.

Applicant is providing an Information Disclosure Statement herewith which lists numerous prior art patents which may be pertinent to the patentability of the present invention.

U.S. Pat. No. 6,003,169 discloses a prefabricated shower pan having an acrylic based solid upper layer, a polystyrene foam layer, and a durable, rigid planar base layer.

U.S. Pat. No. 6,777,063 discloses a backerboard having a shaped cut or groove that allows bending of the backerboard into an L-shaped corner with a rounded out surface and sharp inner surface.

U.S. Patent Publication No. 2006/0183387 discloses a composite board for tile which includes outer reinforcement portions and a polystyrene layer disposed between the two outer reinforcement layers.

Foreign Patent No. DE19945056 discloses a process for locating a bath tub or shower tray, over a water outlet pipe using a carrier with surrounding side walls and a waste pipe outlet section.

U.S. Patent Publication No. 2008/0016614 discloses a modular shower pan which includes at least four polygon panels adapted to interlock in side by side relation to form a body; with each panel having a planar bottom surface and a sloped top surface.

U.S. Pat. No. 7,296,309 discloses a method of constructing a shower enclosure support structure which decreases the probability of mold growth by utilizing interior and/or exterior corner directional flow flashings between the joint.

U.S. Pat. No. 6,647,565 discloses a method of constructing a surface for drainage, and a kit of parts forming components required to produce such a drainage surface.

U.S. Pat. No. 5,845,347 discloses a shower pan which forms a base of a shower and is capable of being built in various sloping configurations.

| | | |
|---|---|---|
| 4,541,132 | Shower Pan | Sep. 17, 1985 |
| 5,845,347 | Method of Manufacturing Shower Foundation | Dec. 8, 1998 |
| 5,911,518 | Shower Bath and Drain | Jun. 15, 1999 |
| 5,913,777 | Pre-Fabricated Shower Module and Method of Shower Construction | Jun. 22, 1999 |
| 6,003,169 | Solid Surface Shower Pan | Dec. 21, 1999 |
| 6,014,780 | Shower Bath and Drain | Jan. 18, 2000 |
| 6,777,063 | Composite Backerboard for Bullnose Support | Aug. 17, 2004 |
| 6,851,133 | Mold Resistant Shower Enclosure | Feb. 8, 2005 |
| 6,990,695 | Shower Pan | Jan. 31, 2006 |
| 7,296,309 | Leak Proof Shower Enclosure Support Structure | Nov. 20, 2007 |
| US 2006/0183387 | Composite Board | Aug. 17, 2006 |
| US 2008/0016614 | Modular Shower Pan | Jan. 24, 2008 |
| DE 19945056 C1 | Bath or Shower Tray Location on a Carrier, Comprises Placing the Edge of the Bath or Tray into a Carrier Groove and then Filling the Latter and the Uncovered area with a Sealant | Nov. 16, 2000 |

BRIEF SUMMARY OF THE INVENTION

The present invention solves the problems in the art in a simple and straightforward manner. What is provided is a one piece drain pan, encapsulated in a water proof membrane, and the method of fabricating the one piece open drain shower pan, the method which includes providing extruded polystyrene (XPS) foam of the type which absorbs very little or no water; shaping the section of extruded polystyrene foam with a CNC router to obtain the desired slope in the floor; cutting a hole in the foam to produce the drain hole; cutting a curb from the XPS foam and gluing the foam to a pan base on the open sides. Splash walls are then cut from concrete wall board and glued to the sides having no curb, so that the glue serves as a bonding agent and provides a waterproof seal between the parts; after the glue has cured, spraying the entire pan assembly with a polyurethane or polyurea coating to completely encapsulate the entire pan with a waterproof membrane, which provides strength and rigidity and defines a one piece drain pan ready for installation.

A second embodiment of the shower pan is to provide a one piece shower pan which provides a recessed drain portion supporting a square insert made of pvc or poly vinyl material which includes a plurality of drain channels extending from the outer edge of each wall of the insert into the recessed drain portion. The insert would be covered by tile members similar to the tiles of the shower floor, so to provide the visual effect of no drainage opening in the floor of the shower. There would be provided a perimeter water flow space between the side edges of the tiles covering the insert and the edges of the surrounding tiles, so that water flowing onto the floor of the shower would flow through the perimeter water flow space, through the drain channels and into the main drain.

Therefore, it is a principal object of the present invention to provide a drainage system for a shower wherein the principal drain opening is covered with floor tiles, and the water flows through flow openings along the edges of the floor tiles covering the main drain.

It is another principal object of the present invention to provide a drain pan having a body of XPS foam, which after assembled, is completed encapsulated with a waterproof membrane polyurethane or polyurea which results in a one-piece, rigid and water proof tileable shower pan.

It is another principal object of the present invention to provide a method of constructing a drain pan by providing a body section of XPS foam, which after it is shaped and assembled, is sprayed and completely encapsulated with a waterproof membrane of polyurethane or polyurea which results in a one-piece, rigid and water proof tileable shower pan.

These and other aspects and advantages will become more apparent after careful consideration is given to the following detailed description of the preferred exemplary embodiments thereof.

BRIEF DESCRIPTION OF THE SEVERAL VIEWS OF THE DRAWINGS

Reference will hereinafter be made to the accompanying drawings, wherein like reference numerals throughout the various FIGURES denote like structural elements, and wherein.

DETAILED DESCRIPTION OF THE INVENTION

FIGS. 1 through 6 illustrate a first preferred embodiment of the one-piece open drain shower pan of the present invention by the numeral 10. FIGS. 7 through 10B illustrate a second embodiment of the present invention, also.

Figure 1:
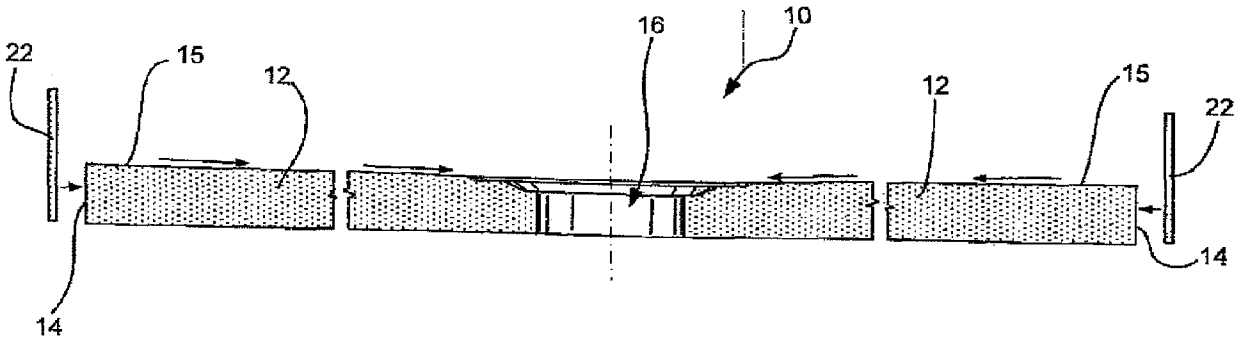
FIG. 1 is a cross-section view of the high density XPS core of the one-piece shower drain of the present invention.

First, as illustrated more particularly in FIGS. 1 through 4, the assembled one-piece shower drain pan 10, also referred to as pan assembly 10, comprises a high density XPS foam core 12, generally rectangular or square in nature, but can be any shape and any size to serve as the floor to a bathroom shower. XPS core 12, as illustrated in cross-section view in FIG. 1, is approximately 1½ to 2 inches in thickness at its outer edges 14, and in its fabrication, in a process which will be discussed further, the upper surface 15 of core 12 is tapered toward the drain opening 16 so that when installed, water flows toward the drain opening 16 and down a drain pipe 18 (phantom view in FIG. 4). As further illustrated in FIG. 3, the drain opening 16 is also configured to allow a drain assembly 20 to be positioned therein, as will be discussed further. FIG. 1 also illustrates a view of the splash walls 22, which are cut from concrete wall board ¼" in thickness, and which will be placed around the edges not open for a curb 14 of the pan 10. The other edge or edges 14 would include a curb 27 for entry into the shower, and as seen in composite view in FIG. 5, to define the assembled shower drain pan 10.

Figure 2:
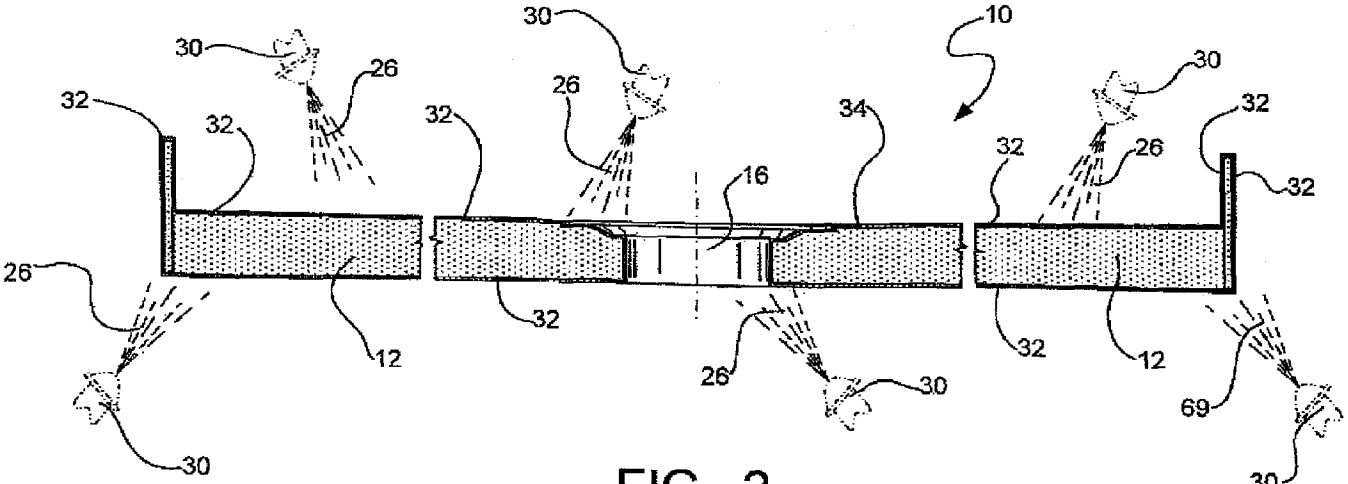
FIG. 2 is a cross-section view of the process of encapsulating the high density XPS core of the one-piece shower drain of the present invention with a layer of polyurethane or polyurea.

The drain pan assembly 10, which includes the splash walls 22 glued in place, would then be encapsulated with a layer of polyurethane or polyurea 26 which would define the one-piece, waterproof shower pan 10 of the present invention. As seen in FIG. 2, this is accomplished by moving the assembled drain pan assembly 10 through a series of spray nozzles 30. However, in the preferred embodiment there may be a single, hand-held spray gun to emit the polyurethane fluid 26, so that each nozzle 30 would emit the polyurethane or polyurea fluid 26 and would form a coating 32 over the entire outer surface 34 of the drain pan 10, which would provide the one-piece, waterproof shower drain pan 10, which would also provide greater strength and rigidity to the drain pan 10.

Figure 3:
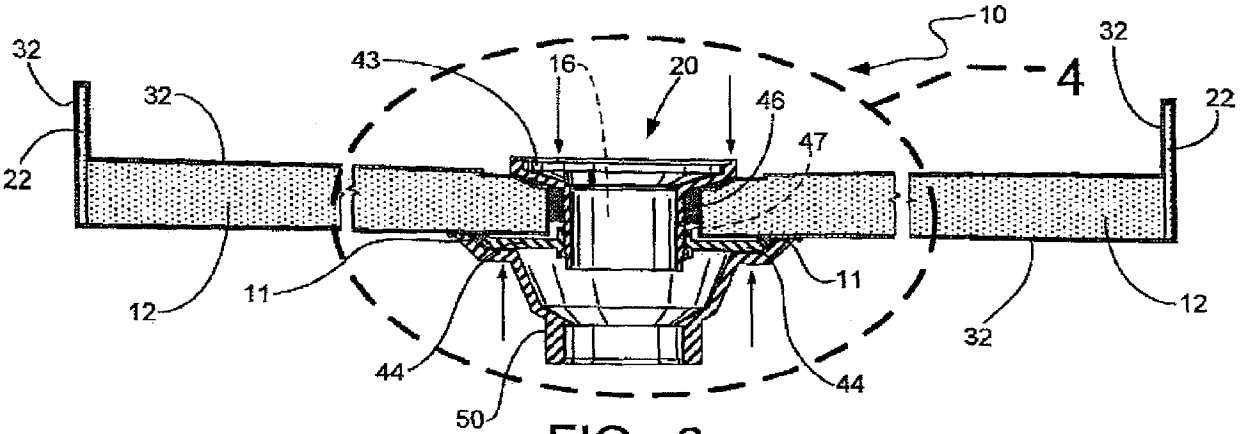
FIG. 3 is a cross-section view along lines 3-3 in FIG. 5 of the one-piece shower drain of the present invention.
Figure 4:
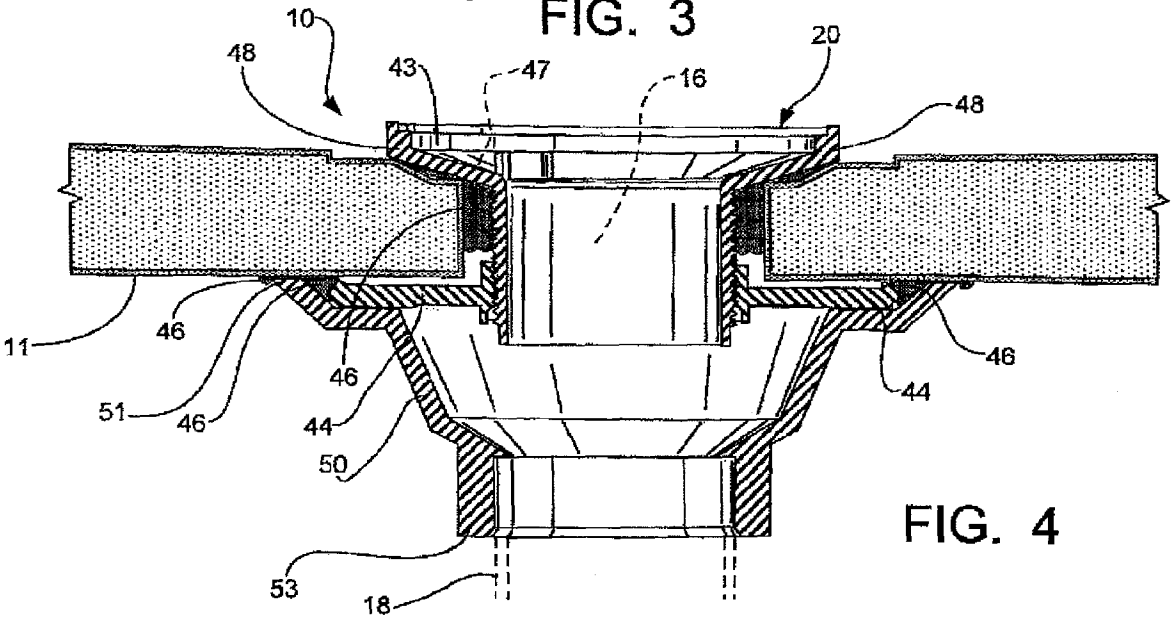
FIG. 4 is a blow-up of the central drain assembly shown in FIG. 3 of the one-piece shower drain of the present invention.

As seen in side view in FIGS. 3 and 4, there is illustrated first in FIG. 3, a cross-section view of the entire shower pan 10, which includes the splash walls 22 and the drain assembly 20. This assembly 20 includes an upper drain portion 48, inserted within drain pan opening 16, and secured in place with a threaded plate 44 which is bolted into underside 11 of the drain pan assembly 10. There is provided a layer of waterproof sealant 46 in the space 47 between the drain pan assembly 10 and the plastic drain portion 48 of the drain assembly 20. Further, to insure water tight security between the upper drain portion 43 and the drain pan assembly 10, there is provided waterproof sealant 46, to fill the gap between the plastic drain 48 and the shower pan 10. On the underside of the bottom plate 44 there is secured a drain body 50 which would connect at its lower end 53 to the drain pipe 18 (phantom view). There is also provided a layer of sealant material 46 between the upper edge 51 of drain body 50 and the underside 11 of the drain pan assembly 10. These structures are more clearly identified in the blowup view of the drain assembly 20.

Figure 6:
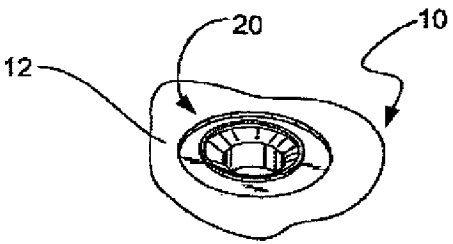
FIG. 6 is an isolated view of the central drain portion of the one-piece shower drain of the present invention.
Figure 5:
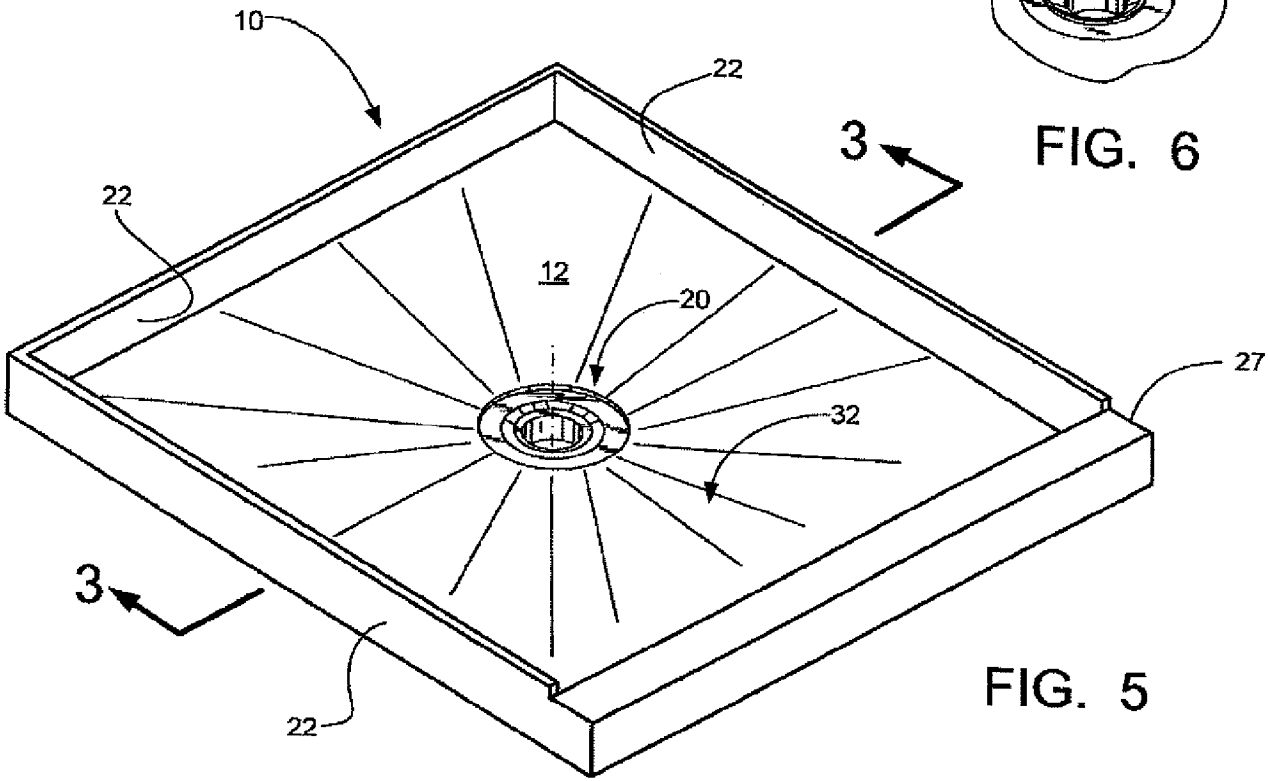
FIG. 5 is an overall perspective view of the fully assembled one-piece shower drain of the present invention.

As identified earlier, FIG. 5 illustrates an overall perspective view of the drain pan assembly 10 of the present invention, showing the three splash walls 22 glued to the XPS core 12, which has been sprayed with the polyurethane coating 32, which would make it a single, water-proof drain pan assembly 10. There is further illustrated the curb 27 which allows entry and exit of the shower when the drain pan assembly 10 is installed in a shower. Although the curb and splash walls could be larger or smaller, in the preferred embodiment, the curb 27 would be four inches high and four inches deep, while the three splash walls 22 would be 4½ inches in height. The assembly 10 also includes the drain assembly 20, in place, in the manner as described with reference to FIGS. 3 and 4. FIG. 6 illustrates an isolated overall view of the drain assembly 20 as it would be installed into the drain pan assembly 10.

As explained earlier, in the process to provide the one piece assembly 10 to the customer, as a one piece drain pan 10 encapsulated in a polyurethane water proof coating 32, the method includes the steps of providing a one piece section XPS foam core 12 of the type which absorbs very little or no water; shaping the section of extruded polystyrene foam 12 with a CNC router to obtain the desired slope in the upper surface 15, to define the floor; cutting the central hole 16 in the foam 12 to serve as the drain opening; cutting the curb 27 from the XPS foam 12 and gluing the foam 12 to a pan base on the open sides. Splash walls 22 are then cut from concrete wall board and glued to the edges 14 having no curb 27, so that the glue serves as a bonding agent and provides a waterproof seal between the parts. After the glue has cured, spraying the entire pan assembly 10 with a polyurethane or polyurea coating 32 to completely encapsulate the entire pan 10 with a waterproof membrane 32, which provides strength and rigidity and defines a one piece drain pan 10 ready for installation at the site by the installer. The drain pan assembly 10 is then installed onto the shower space.

To help guide through the shower pan installation process, there is provided the following Installation Guide, which is intended to provide an easy to follow step-by-step process for the installation of one piece shower pan 10.

In the installation process, what follows are the preferred instructions for installing the ITS shower pan.

1. Sweep and clean any debris from the shower stall floor space.

2. Test fit the 3-piece drain provided with the shower pan 10 to make sure that the top of the main section of the drain finishes out about 1/16 to 1/8 of an inch above the slab or sub floor. (Drain pipe should be cut approx. 1 13/16" below surface of slab or sub floor) If it does not fit, make necessary adjustments in order to achieve the correct finishing height.

3. Test fit the shower pan to make sure of proper fit of the pan and the drain location. Remove the pan after test fitting is complete.

4. Attach the 3-piece drain to the drainpipe using the industry recommended adhesive. After attachment, remove the height adjustable piece of the drain.

5. Place two (2) ¾"x¾" or larger boards on the floor to the slide the pan into place.

6. Apply thin-set adhesive (latex modified rapid setting material is recommended) using a ½" square notch trowel to the slab or sub floor, making sure to apply the adhesive all the way to the edge of the 3-piece drain. It is not necessary under the wooden slides.

7. Apply a ½" bead of caulk to the rim of the main piece of the 3-piece drain.

8. Carefully slide the tileable shower pan into place and remove the wooden slides. Once in place, apply pressure to the shower pan to ensure a proper seal with the thin-set and caulk. Using a level, make certain that the shower pan is level on all sides in order to ensure proper water drainage.

9. Apply a liberal bead of caulk around the opening for the drain and then insert the adjustable drain piece and hand tighten this piece to the rest of the drain. Remove the excess caulk around the edge of the drain.

10. Allow the thin-set to dry to manufacturers recommendations before continuing.

11. It is now ready to hang Backer Board in the shower. Before securing the backer board to the studs, apply a bead of caulk to the top edge of the shower pan splash Walls and allow the backer board to rest on the top edge of the shower pan.

12. Once completed, one should always waterproof all seams within the shower space.

13. The installer is now ready to begin laying tile.

FIGS. 7 through 10B illustrate a second embodiment of the present invention, with improvements and innovations in the manner in which the drainage system operates.

Figure 7:
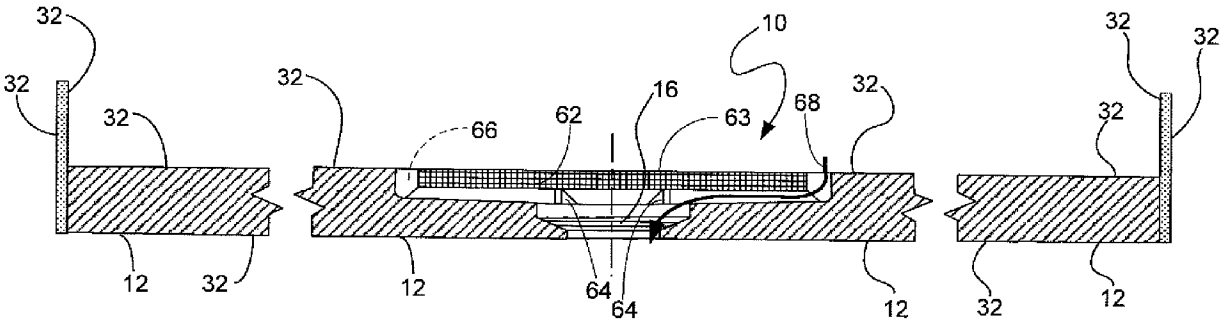
FIG. 7 illustrates a cross section view of an additional embodiment of the one-piece shower drain of the present invention.

As illustrated first in FIG. 7, the second embodiment of the present invention, as with the first embodiment, includes the high density XPS core 12 having a coating 32 there around. The core 12 is surrounded by the splash walls 22 which altogether define the drain shower pan 10. In this embodiment, it should be noted that the core 12 in its central portion which houses the main drain opening and assembly 16 is a square recessed area 60 wherein there is positioned an insert 62 made of pvc or poly vinal material which is supported by a plurality of support members 64 on its underside to give it stability. When in place, the insert 62 has a central opening which is aligned with the main drain 16. The insert 62 is resting on the supports 64 and there is defined a drainage space 66 flowing from the edges 70 of insert 62 through the drainage space 66 in the direction of Arrow 68 and into the main drain 16. This feature is seen more clearly in views in FIGS. 8 and 9 where the insert member 62 is resting on the support 64 showing the drain channel 66 so that water would flow in the direction of Arrow 68 as seen in both FIGS. 8 and 9. As seen further in FIG. 8, with the insert 62 in place, and the upper surface 63 flush with the upper surface 15 of the core 12, there is illustrated a layer of ceramic tiles 80 covering the entire shower floor. This in effect provides a visual effect of a person looking into the shower that there is no central drain as is present in all showers. The operation of this unique setup will be discussed further.

Figure 10B:
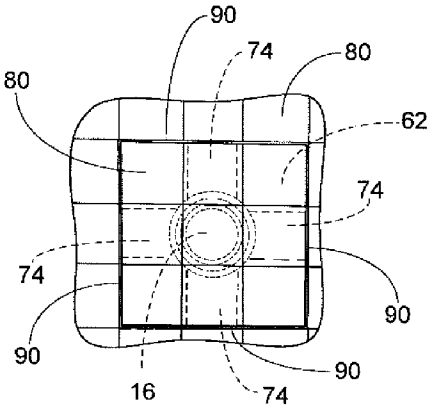
FIG. 10B illustrates a top view of the insert showing the tiles laid there over with the insert shown in phantom view.
Figure 10A:
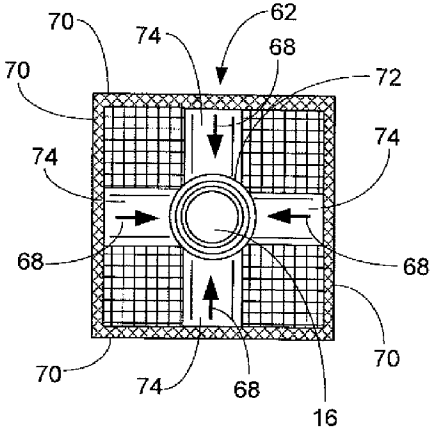
FIG. 10A illustrates a top view of the square insert which is positioned on the main drainage assembly below the tiles of the shower in the floor.

As seen in FIG. 10A, there is a top view of the insert 62 where it seen that it has four edges 70 and a central body portion 72. The central body portion 72 is provided with a plurality of drain channels 74, each of the drain channels extending to a central opening in the insert from each of the outer edges 70 of the member 62 to allow fluid flow in the direction of Arrows 68 into the main drain channel 16.

Figure 8:
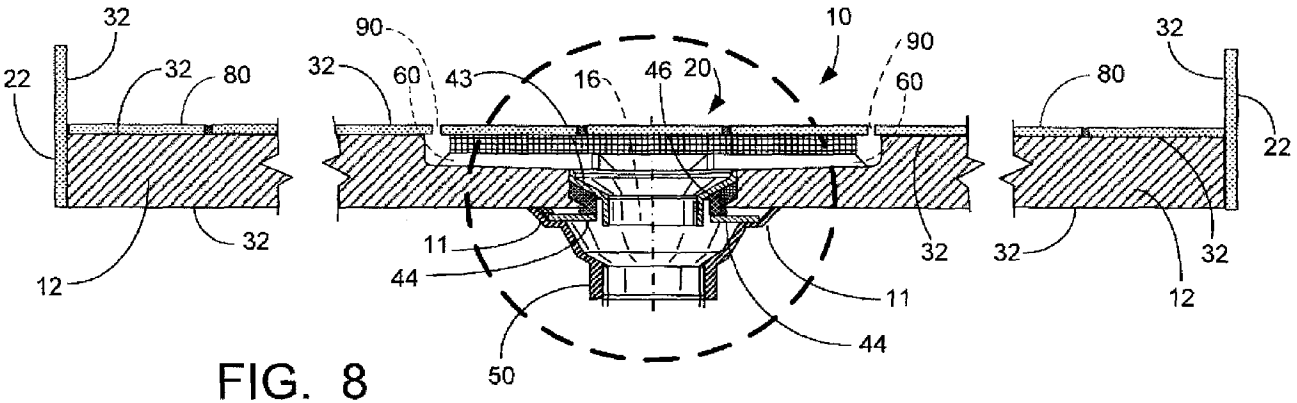
FIG. 8 illustrates a second cross section view of the additional embodiment of the shower drain of the present invention with the principal drainage assembly in place.
Figure 9:
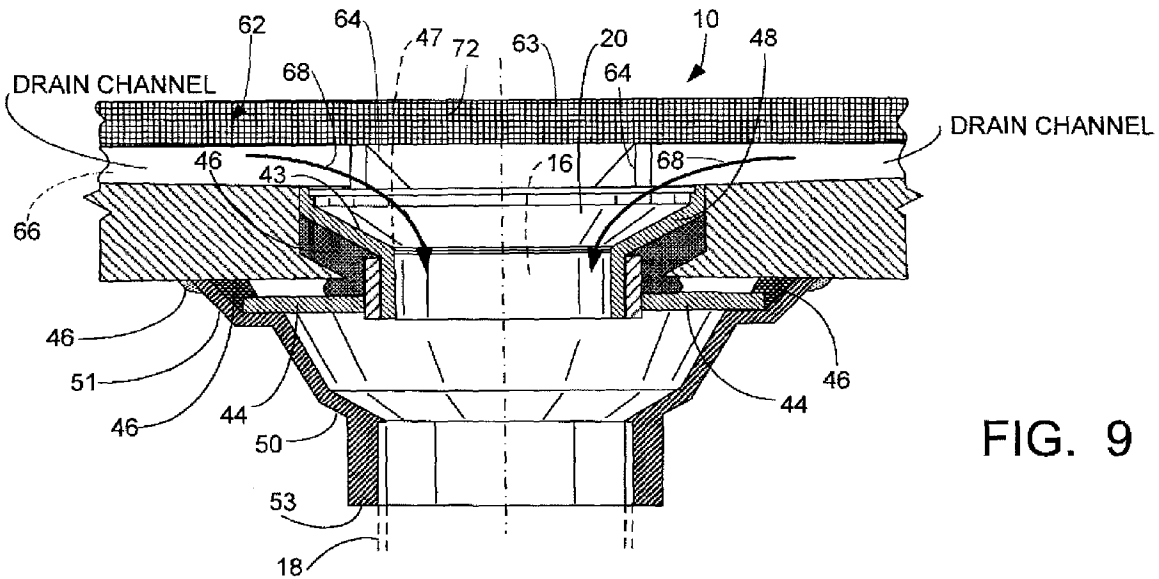
FIG. 9 illustrates an isolated view of the additional embodiment of the present invention taken from FIG. 8.

FIG. 10B illustrates an important critical feature of this principal embodiment of the present invention in top view, as does FIG. 8 in side view. As illustrated, the insert 62 is seen in phantom view from a top view with the floor tiles 80, such as ceramic tiles, of the shower in place and covering the entire shower floor, including the insert 62 and also covering the main drain 16. Therefore, there would be no apparent drain at the shower floor. However, FIGS. 8 and 10B show a flow openings 90 along the edges of the tiles 80 which cover the insert 62. When the tiles 80 are in place and are cemented in place onto insert 62, the outer edges between the tiles 80 covering the insert 62 and the tiles 80 which mate with these four edges, remain ungrouted, and therefore, as seen in FIG. 8, there is defined the flow opening 90 between the tiles 80 which cover the insert 62 and the tiles 80 which surround it. Therefore, water flows from the shower floor into the flow space 90 defined by the gap between the edges of the tiles 80 and into the four flow channels 74 and into the principal drain 16. Therefore, this construction defines an "invisible" drain on this improved shower system which allows full water flow from the shower floor into the main drain without an apparent flow opening anywhere in the floor of the shower.

Although the drainage system disclosed in this second embodiment is discussed and illustrated as being incorporated into the pan of a shower, it is foreseen that the drainage components, such as the insert 62, the supports 64, and drainage assembly 16, as disclosed, would not necessarily be incorporated into a pan but could be utilized from a standard concrete mud bed. In effect, the pan would not be utilized and the concrete mud bed would be brought up to the drainage unit.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The following is a list of parts and materials suitable for use in the present invention.

PARTS LIST

Part Number Description

10 drain shower pan
11 underside
12 high density XPS core

14 outer edges
15 upper surface
16 drain opening
18 drain pipe
20 drain assembly
22 splash walls
26 polyurethane/polyurea
27 curb
30 spray nozzles
32 coating
34 outer surface
40 central drain assembly
43 drain top
44 threaded bottom plate
46 tile sealant
47 space
48 plastic drain portion
50 drain body
51 upper edge
53 lower end
60 recessed area
62 pvc or poly vinyl insert
63 upper surface
64 support members
66 drainage space
68 arrow
70 edges
72 central body portion
74 drainage channels
80 ceramic tiles
90 flow openings All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An improved one-piece shower pan assembly, comprising:

a. a section of extruded foam having a generally flat bottom surface and a floor surface having a central drain hole;

b. a recessed area formed in the floor surface around the drain hole for positioning a height adjustable drain assembly;

c. an adjustable flat insert, for covering with tile members similar to tile members of a shower floor, positioned above the drain assembly within the recessed area so that the upper surface of the flat insert is flush with the floor surface;

d. a plurality of drain channels on an upper surface of the adjustable flat insert for allowing water to flow from the upper surface of the adjustable flat insert through the drain channels, into a central opening in the insert, and into the drain assembly;

e. an outermost layer of polyurethane sprayed over the section of extruded foam and the adjustable flat insert to define a waterproof membrane over these elements as a whole;

f. a layer of flooring comprised of flooring tiles having edges in alignment with the edges of the insert, wherein the layer of flooring is placed on the entire floor surface including on the adjustable flat insert, so to provide the visual effect of no drainage opening in the floor of the shower; and g. flow openings in the flooring tiles defined by having no grout between the edges of some of the tiles covering the adjustable flat insert and the edges of tile surrounding the adjustable flat insert so that water on the floor surface can flow through the flow openings and into the drain channels and into the drain assembly.

2. The shower pan assembly in claim 1, wherein there are provided four drain channels formed in the upper surface of the adjustable flat insert, extending from four edges of the adjustable flat insert.

3. The shower pan assembly in claim 1, wherein the flooring comprises a plurality of ceramic type tiles grouted together to define the shower floor.

4. The shower pan assembly in claim 3, wherein the flow openings in the flooring tiles are defined by having no grout between the edges of tile on the adjustable flat insert and the edges of tile surrounding the flat plate without having to change the configuration of the flooring tiles in order to form the flow openings.

5. The assembly in claim 1, wherein the extruded foam comprises extruded polystyrene (XPS) foam.

6. The assembly in claim 1, wherein the extruded foam absorbs little or no water.

7. An improved one-piece shower pan assembly, comprising:

a. a section of extruded foam having a generally flat bottom surface and a floor surface having a central drain hole;

b. a recessed area formed in the floor surface around the drain hole for positioning a height adjustable drain assembly;

c. an adjustable flat insert, the adjustable flat insert positioned above the drain assembly within the recessed area so that the upper surface of the adjustable flat insert is flush with the floor surface for receiving tile similar to the tiles of the shower floor to be laid thereupon;

d. a plurality of drain channels on the upper surface of the adjustable flat insert for allowing water to flow from the floor surface through the drain channels and into the drain assembly;

e. an outermost layer of polyurethane sprayed over the section of extruded foam having the recessed area formed in the floor surface around the drain hole, and the adjustable flat insert positioned above the drain assembly within the recessed area so there is defined the plurality of drain channels on the upper surface of the flat insert, to define a waterproof membrane over these elements as a whole; and f. a layer of floor tiles placed on the entire floor surface, with flow openings formed between the floor tiles on the adjustable flat insert, and the surrounding floor tiles by eliminating grout between the tiles, and without having to change the configuration of the flooring tiles in order to form the flow openings which communicate with the drain channels in the adjustable flat insert, so that water on the floor surface can flow through the flow openings and into the drain channels and into the drain assembly.

8. The one-piece shower assembly in claim 7 wherein the adjustable flat insert comprises pvc or poly vinyl material.

9. An improved shower drain assembly for use in a shower having a floor surface of extruded foam with a central drain hole, the assembly comprising:

a. a height adjustable drain assembly portion to be positioned in the central drain hole;

b. an adjustable flat plate insert positioned above the drain assembly so an upper surface of the adjustable flat plate insert is flush with the floor surface surrounding the flat plate insert for receiving floor tiles to be laid thereupon;

c. a plurality of drain channels on the upper surface of the adjustable flat plate insert for allowing water to flow from the floor surface into the drain channels and into the drain assembly;

d. an outermost layer of polyurethane sprayed over the section of extruded foam and the flat plate insert to define a waterproof membrane over these elements as a whole; and e. a layer of upper ceramic floor tiles placed on the entire floor surface, with flow openings formed between the ceramic tiles by not having grout between the tiles at a location along edges of the adjustable flat plate insert, which communicate with the drain channels in the adjustable flat plate, so that water on the floor surface can flow into the flow openings and into the drain channels.

10. The improved shower drain assembly in claim 9, wherein the adjustable flat plate insert comprises pvc or poly vinyl material.

11. The improved shower drain assembly in claim 9, wherein the assembly may be positioned within a standard concrete mud bed known in the art.

12. A method of fabricating an improved shower drain assembly for use in a shower having a floor surface of extruded foam with a central drain hole, comprising the steps of:

a. providing a drain assembly portion to be positioned in the central drain hole;

b. positioning an adjustable flat plate insert above the drain assembly so an upper surface of the adjustable flat plate is flush with the floor surface surrounding the plate;

c. forming a plurality of drain channels on the upper surface of the adjustable flat plate insert for allowing water to flow from the floor surface into the drain channels and into the drain assembly;

d. spraying an outermost layer of polyurethane over the extruded foam having a recessed area formed in the floor surface around the drain hole; the adjustable flat insert positioned above the drain assembly within the recessed area so there is defined the plurality of drain channels on the upper surface of the adjustable flat plate insert to define a waterproof membrane over these elements as a whole; and e. after the polyurethane layer has dried, placing a layer of upper ceramic floor tiles on the entire floor surface, with flow openings formed between the ceramic tiles by not having grout between the tiles at a location along edges of the adjustable flat plate insert, which communicate with the drain channels in the adjustable flat plate insert, so that water on the floor surface can flow into the flow openings and into the drain channels.

* * * * *